United States Patent [19]

Sweeney et al.

[11] Patent Number: 4,704,217

[45] Date of Patent: Nov. 3, 1987

[54] GASOLINE CRANKCASE LUBRICANT

[75] Inventors: William M. Sweeney, Wappinger Falls; Benjamin H. Zoleski, Beacon; Rodney L. D. Sung, Fishkill, all of N.Y.; Wheeler C. Crawford, Houston, Tex.

[73] Assignee: Texaco Inc., White Plains, N.Y.

[21] Appl. No.: 898,278

[22] Filed: Aug. 20, 1986

[51] Int. Cl.[4] ..... C10M 129/68; C10M 133/00

[52] U.S. Cl. ..... 252/32.7 E; 252/50; 252/51.5 R; 252/33

[58] Field of Search ..... 252/51.5 R, 327 E, 33, 252/5

[56] References Cited

U.S. PATENT DOCUMENTS

| | | | |
|---|---|---|---|
| 3,238,130 | 3/1966 | Matson | 252/51.5 R |
| 3,456,013 | 7/1969 | Egan et al. | 252/51.5 R |
| 3,464,925 | 9/1969 | Benoit et al. | 252/51.5 R |
| 3,637,358 | 1/1972 | Cyba | 252/51.5 R |
| 3,657,129 | 4/1972 | Obermeier | 252/51.5 R |
| 4,231,883 | 11/1980 | Malec | 252/51.5 R |
| 4,305,834 | 12/1981 | Barber et al. | 252/51.5 R |
| 4,382,006 | 5/1983 | Horodysky | 252/51.5 R |
| 4,391,610 | 7/1983 | Sung et al. | 44/56 |
| 4,409,000 | 10/1983 | LeSeur | 252/51.5 R |
| 4,460,379 | 7/1984 | Sweeney et al. | 44/56 |

OTHER PUBLICATIONS

Smallheer, Lubricant Additives, pp. 2–3, 7.

*Primary Examiner*—William R. Dixon, Jr.
*Assistant Examiner*—Cynthia A. Prezlock
*Attorney, Agent, or Firm*—Robert A. Kulason; James J. O'Loughlin; Vincent A. Mallare

[57] ABSTRACT

The friction modifying property of gasoline crankcase oil is improved by the incorporation therein of a friction modifier of a dialkoxylated alkyl polyoxyalkyl amine

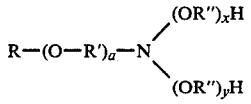

wherein R is a ($C_1$–$C_{20}$) hydrocarbyl radical, R′ and R″ are divalent ($C_1$–$C_{10}$) alkylene groups, a is an integer of about 1 to about 10 and x+y is a value of about 1 to about 20.

15 Claims, No Drawings

GASOLINE CRANKCASE LUBRICANT

FIELD OF THE INVENTION

Energy costs, particularly as illustrated by the cost of crude oil and liquid petroleum distillates derived from crude oil, have escalated rapidly. These costs are especially burdensome to the consumers. Any material, which can be added to a lubricant which will promote fuel economy in today's energy conscious world, is important. One area where such materials could be advantageously utilized is in gasoline crankcase engine lubricants.

BACKGROUND OF THE INVENTION

There are many instances as well known, particularly under boundary lubrication conditions, where two rubbing surfaces must be lubricated, or otherwise protected, so as to prevent wear and to insure continued movement. Moreover, where, as in most cases, friction between the two surfaces will increase the power required to effect movement and where the movement is an integral part of an energy conversion system, it is most desirable to effect the lubrication in a manner which will minimize this friction. As is also well know, both wear and friction can be reduced, with various degrees of success, through the addition of a suitable, or combination thereof, to a natural or synthetic lubricant. Similarly, continued movement can be insured, again with varying degrees of success, through the addition of friction modifier.

Numerous means have been employed to reduce the friction in internal combustion engines. These range from the use of lower viscosity lubricating oils, or mixtures of mineral and synthetic lubricating oils, as well as to the incorporation of friction-reducing additives such as graphite, molybdenum compounds and other chemical additives. There are limits to the extent to which the viscosity of a lubricating oil can be reduced for the purpose of reducing friction. Generally, a lubricating oil, havng too light a viscosity, will fail to prevent metal-to-metal contact during high-load operating conditions with the result that unacceptable wear will occur in the engine. With respect to chemical anti-friction additives, significant research efforts are going to find effective and economic anti-friction additives which exhibit stability over an extended service life and under a wide range of operating conditions.

It is an object of this invention to provide a novel lubricating oil composition for a gasoline crankcase engine.

It is another object of this invention to provide an overbased lubricating oil having improved friction properties for lubricating gasoline crankcase engines.

INFORMATION DISCLOSURE STATEMENT

U.S. Pat. No. 4,391,610 teaches the art of using a dialkoxylated alkyl polyoxyalkyl amine as a novel corrosion inhibitor for neat alcohol fuels.

U.S. Pat. No. 4,460,379 discloses the use of dialkoxylated alkylpolyoxyalkylamine as a middle distillate storage stabilizing agent.

SUMMARY OF THE INVENTION

The crankcase lubricating oil composition of this invention comprises a major portion of a gasoline crankcase lubricating oil, an 18:1 overbased calcium sulfonate in an amount sufficient to impart a Total Base Number (TBN), ranging from about 0 to about 10, preferably from about 3 to about 5, to the lubricating oil composition, a zinc dihydrocarbyl dithiophosphate and a minor friction modifying amount of a dialkoxylated alkyl polyoxyalkyl amine represented by the formula

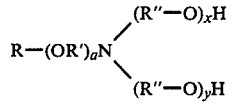

where R is a ($C_1$–$C_{20}$) hydrocarbyl radical, R′ and R″ are ($C_1$–$C_{10}$) divalent alkylene groups, a is an integer of about 1 to about 10 and x+y is a value of about 1 to about 20.

Also, in the above formula, for example, R may be an alkyl group typified by methyl, ethyl, propyl, isopropyl, n-butyl, isobutyl, amyls, hexyls, octyls, etc. R may contain from about 1 to about 20 carbon atoms, preferably from about 10 to about 15, or most preferably, from about 10 to about 12 carbon atoms.

And, R′ and R″ may be divalent alkylene groups containing from about 1 to about 10 carbon atoms, preferably from about 1 to about 4 carbon atoms and, most preferably, from about 2 to about 3 carbons. Preferably,

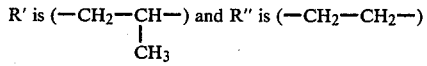

SPECIFIC EMBODIMENTS OF THE INVENTION

In a more specific embodiment of the invention, the lubricating composition of the invention comprises at least about 80 percent of a mineral lubricating oil, from about 0.1 to about 1.5 wt.% of an 18:1 overbased calcium sulfonate which imparts a Total Base Number (TBN) to the lubricating oil composition ranging from about 0 to about 10, preferably from about 3 to about 5, from about 0.1 to about 2.0 wt.% of a zinc dithiophosphate which is represented by the formula

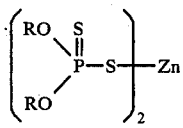

where R is a ($C_1$–$C_{20}$) hydrocarbyl radical or a hydroxy substituted hydrocarbyl radical, about 8 vol.% of phosphosulfurized polyisobutene wherein the polyisobutene's molecular weight is 1290, from about 0.1 vol.% to about 1.0 vol.% of a Viscosity Index Improver, and from about 0.01 to 0.1 vol.% of an oxidation inhibitor, e.g., an alkylated diphenylamine, which is represented by the formula

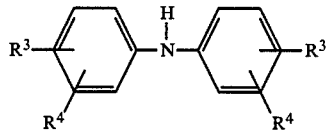

where $R^3$ is a ($C_1$–$C_4$) alkyl radical and $R^4$ is a ($C_4$–$C_{16}$) alkyl radical, and a minor friction modifying amount of a dialkoxylated alkyl polyoxylalkyl amine having the formula

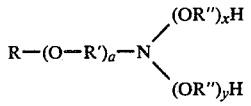

where R is a ($C_1$–$C_{20}$) hydrocarbyl radical, R′ and R″ are ($C_1$–$C_{10}$) divalent alkylene groups, x+y is a value of about 1 to about 20, preferably about 15, and a is an integer of about 1 to about 10, preferably from about 1 to about 5 and, most preferably, from about 1 to about 2.

In the above formula, R may be an alkyl group typified by methyl, ethyl propyl, isopropyl, n-butyl, isobutyl amyls, hexyls, octyls, etc. R may contain from about 1 to about 20 carbon atoms, preferably from about 10 to about 15 and, most preferably, from about 10 to about 12 carbon atoms.

R′ and R″ may be divalent alkylene groups containing from about 1 to about 10 carbon atoms, preferably from about 1 to about 4, and, most preferably, from about 2 to about 3 carbon atoms.

The amines which may be used in the present process are provided below in Table I, the first being preferred.

TABLE I

A.

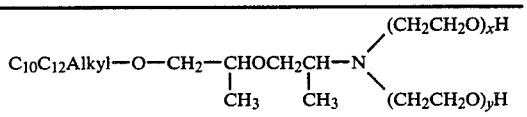

where x + y = 20

B.

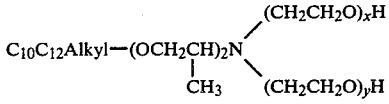

where x + y = 10

C.

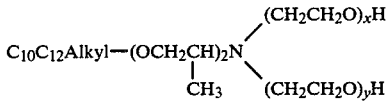

where x + y = 5

D.

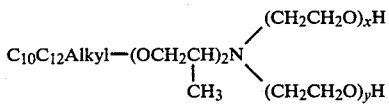

where x + y = 15

These materials may be commerically available or they may be prepared as by diethoxylating the Jeffamine M-300 brand of amine represented by following formula

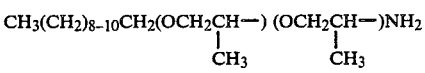

The Jeffamine brand of amines are manufactured and marketed by Texaco Chemical Co., Houston, Tex.

These materials may be prepared by the following series of reactions which illustrate a typical synthesis:

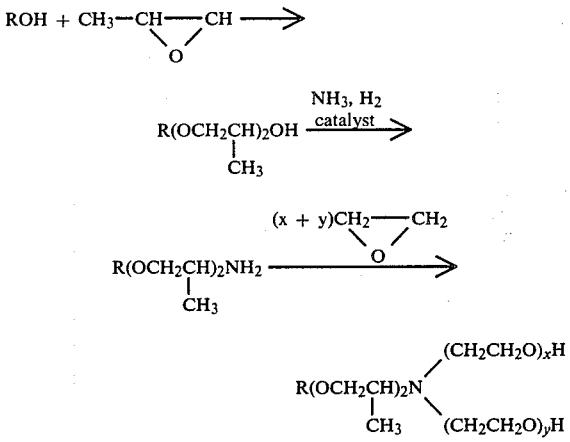

The practice of this invention will be apparent to those skilled in the art from the following example wherein, as elsewhere in this specification, all parts are parts by weight unless otherwise specified.

EXAMPLE

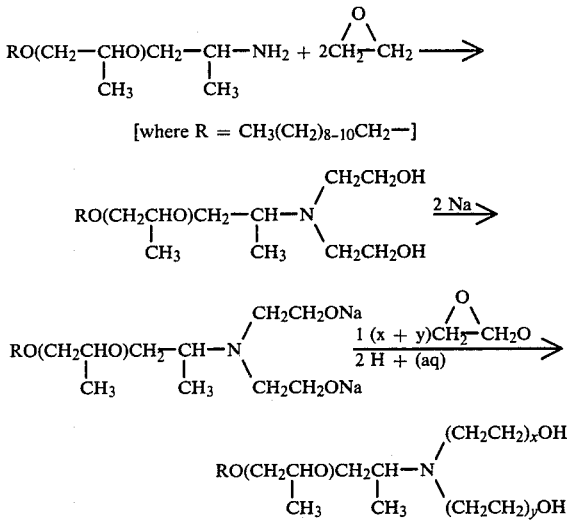

[where R = $CH_3(CH_2)_{8-10}CH_2$—]

In this example, which illustrates the best mode known to us of practicing the present process, there is added to a reaction vessel 189.5 g (1 mole) of Jeffamine M-300 brand of amine which is represented by the formula

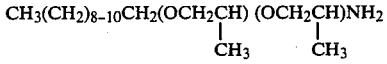

together with 200 g of diethylene glycol monomethyl ether solvent. The vessel is evacuated and flushed with nitrogen. Ethylene oxide (660 g; 15 moles) is passed in at 150° C./20 psig over 2 hours. The reaction mixture is diluted with an excess of water. Hydrochloric acid (aqueous) is added to lower the pH to about 11. Then, water is removed by vacuum distillation followed by stripping at 165° C. under vacuum.

There is then added, to the cooled reaction mixture, 46 grams (2 moles) of sodium metal. After the sodium has completely reached to form III, as evidenced by stoppage of hydrogen generation, 220 g (5 moles) of ethylene oxide is passed into the reaction vessel at 50° C. for 2 hours. At the end of this time, the product is hydrolyzed by the addition of 250 ml of aqueous hydrochloric acid.

The product is a surfactant manufactured and marketed under an M-series (e.g., Surfactant M-300) by Texaco Chemical Co. of Houston, Tex. Here, the product is Surfactant M-302 which is represented by the formula

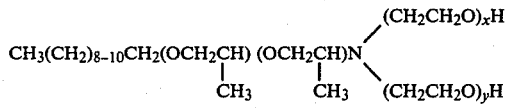

where $x+y=2$.

Water and solvent are removed by vacuum distillation followed by stripping at 165° C. under vacuum. The product is a liquid having a molecular weight of 949.5.

Five parts per thousand barrels (corresponding to 0.0019 wt.%) of this composition is added to a lubricating oil. The composition (i.e., surfactants) may be Surfactant M-305 which is represented by the formula

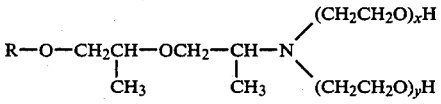

(where R is a $C_{10}C_{12}$ alkyl group and $x+y=5$) or the product may be Surfactant M-320 which is represented by the formula

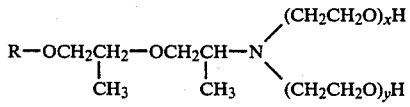

(where R is a $C_{10}C_{12}$ alkyl group and $x+y=20$) or the product may be Surfactant M-310 which is represented by the formula

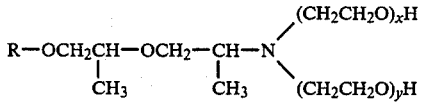

(where R is a $C_{10}C_{12}$ alkyl group and $x+y=10$) or the product may be Surfactant M-315 which is represented by the formula

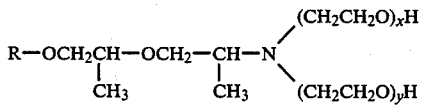

(where R is a $C_{10}C_{12}$ alkyl group and $x+y=15$).

The polyalkoxylated alkyl polyoxy alkyl amine was tested in a range from about 0.2 to about 5 wt.% based on the total lubricating oil composition. However, it is preferred to employ from about 0.5 to about 2 wt.% of the dialkoxylated alkyl polyoxyalkyl amine on the lubricating oil with the most preferred concentration, ranging from about 0.75 to about 1.5 wt.%.

A second essential component of the crankcase lubricating oil composition of the invention is an 18.1 over-based calcium sulfonate, in a sufficient amount, to provide a Total Base Number ranging from about 1 to about 10 in the finished crankcase lubricating oil composition. Total Base Number (TBN) is a measure of alkalinity determined according to the test procedure outlined in ASTM D-664.

The essential zinc dithiophosphate component of the lubricating oil is represented by the formula

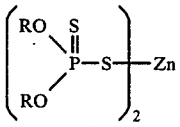

wherein R is a ($C_1$–$C_{20}$) hydrocarbyl radical or a hydroxy-substituted hydrocarbyl radical. The preferred zinc dithiophosphates are those in which R represent an alkyl radical having from about 4 to about 8 carbon atoms. Examples of suitable compounds include zinc isobutyl 2-ethylhexyl dithiophosphate, zinc di(2-ethylhexyl)dithiophosphate, zinc isoamyl 2-ethylhexyl dithiophosphate, zinc di(phenoxyethyl)dithiophosphate and zinc di(2,4-diethylphenoxyethyl)dithiophosphate. In general, these compounds are employed in the oil composition in a concentration ranging from about 0.1 to 2.0 wt.%, with a preferred concentration ranging from about 0.5 to about 1.5 wt.%. These compounds can be prepared from the reaction of a suitable alcohol, or mixture of alcohols, with phosphorus pentasulfide.

One particular supplemental additive for use in the concentrates and finished lubricating oil composition contemplated herein is the ethyoxylated derivative of inorganic phosphorus acid-free, steam hydrolyzed polyalkene $P_2S_5$ reaction product prepared by first reacting a polyalkene (e.g., polybutene) of a molecular weight of between about 800 to about 2,500, wherein the reaction mixtures constitute between about 5 and to about 40 wt.%. $P_2S_5$ in a non-oxidizing atmosphere, e.g., nitrogen, followed by hydrolyzing the resultant product by contracting with steam at a temperature between about 100° C. and 260° C., the steam treatment of the $P_2S_5$-polyalkene reaction product results in hydrolysis to form inorganic phosphorus acids in addition to the hydrolyzed organic product.

The inorganic phosphorus acids are removed from the hydrolyzed product prior to reaction with alkylene oxide by a standard procedure such as those disclosed in U.S. Pat. Nos. 2,951,835 and 2,987,512, wherein removal is effected by contact with synthetic hydrous alkaline earth metal silicates and synthetic hydrous alkali metal silicates respectively. Inoranic phosphorus acids also can be removed by extraction with anhydrous methanol is disclosed in U.S. Pat. No. 3,135,729. The steam hydrolyzed inorganic phosphorus acid product is then contacted with ethylene oxide at a temperature between about 60° and 145° C. under a pressure ranging from about 0 to 50 psig utilizing a mole ratio of ethylene oxide to hydrolyzed hydrocarbon $P_2S_5$ reaction product of between about 1:1 and 4:1, preferably about 1.1:1 and 1.5:1. Excess ethylene oxide is removed from completion of the reaction by blowing the reaction mixture at an elevated temperature, generally with an inert gas such as nitrogen.

The prescribed lubricating oil composition of the invention may contain additional known lubricating oil additives. For example, an oxidation inhibitor, can be employed, which is an alkylated diphenylamine represented by the formula

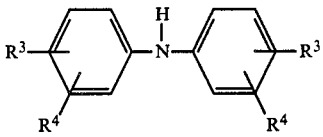

wherein $R^3$ is a ($C_1$–$C_4$) alkyl radical and $R^4$ is a ($C_4$–$C_{16}$) alkyl radical. A more preferred compound is one in which $R^4$ is a tertiary alkyl hydrocarbon radical having from 6 to 12 carbon atoms. Examples of typical compounds include 2,2'-diethyl, 4,4'-tert.dioctyldiphenylamine, 2,2-diethyl, 4,4'-tert.dioctylphenylamine 2,2'-diethyl, 4-tert. octyldi-phenylamine, 2,2' dimethyl-4,4'tert.dioctyldiphenylamine, 2,5-diethyl, 4,4'-tert.-dihexyldiphenylamine, 2,2,2',2'-tetraethyl, 4,4'-tert-.didodecyldiphenylamine and 2,2' dipropyl 4,4'-tert-.dibutyldiphenylamine. Mixtures of the foregoing compounds can be employed with equal effectiveness. The alkylated diphenylamine is normally employed in an oil composition in a concentration ranging from about 0.1 to about 2.5 wt.%, based on the weight of the lubricating oil composition, with the preferred concentration being from about 0.25 to about 1.0 percent after supplementary additives, e.g., viscosity Index Improver and anti-foamant are included.

The hydrocarbon oil, which can be employed to prepare the crankcase lubricating oil composition of the invention, includes naphthenic base, paraffinic base and mixed base mineral oils, lubricating oil derived from coal products and synthetic oils, e.g., alkylene polymers such as polypropylene and polyisobutylene of a molecular weight of between about 250 and about 2500. Advantageously, a lubricating base oil, having a lubricating oil viscosity SUS at 100° F. of between about 6.0 and about 16.0, preferably between 8.0 and 14.0, are normally employed for the lubricant composition. The most preferred lubricating viscosity for a crankcase lubricating oil composition is a viscosity ranging from about 9.3 to about 12.5 SUS at 240° F. The hydrocarbon oil will generally constitute from about 80 to about 90 wt.% of the total lubricating oil composition with the preferred concentration range being from about 82 to about 88 wt.%.

The improvement in fuel economy brought about by the novel crankcase lubricant composition of the present invention was demonstrated in the Four-Ball, Coefficient of Friction Test where the apparatus used was as described below.

Apparatus: A four-ball wear test machine is used. Four balls are arranged in an equilateral tetrahedron. The lower three balls are clamped securely in a test cup filled with lubricant and the upper ball held by a chuck which is motor driven causing the upper ball to rotate against the fixed lower balls. A load is applied in an upward direction through a weight/lever arm system. Loading is incremental (minimum increment is 1.0 kg) except for the Roxana tester which has a continuously variable loading system. Heaters allow operation at elevated oil temperatures. On some machines, a strain arm system and accompanying instrumentation allow measurement and recording of friction. With the exception of the Roxana Machine, which has continuously variable speed control up to 3600 rpm, the test speeds available for each tester are 600 rpm, 12000 rpm and 1800 rmp.

In this test, the machines can be adapted to running wear tests using discs instead of balls in the test cup. Disc metals may be of bronze, brass, silver, aluminum and other materials upon request. The conditions of the various test procedures as to speed, load, temperature and time (i.e., duration) are provided below in Table II along with the type of result reported for each test.

TABLE II

| | TEST PROCEDURES | | | |
|---|---|---|---|---|
| Test | One-Hour Wear | Navy Wear | One-Hour Wear | Two-Hour Wear |
| Speed, rpm | 600 | 1800 | 1800 | 600 |
| Load, kg | 1, 10 and 40 | 28 | 40 | 40 |
| Temperature, °F. | 167 | Room | 200 | 200 |
| Duration, min. | 60 at each load | 10,40,70,100 (separate run at each duration) | 60 | 120 |
| Type of Test Results: | Average scar diameter. Wear (microns - average scar diameter for each load per minute) | | | |

The frictional effects of the novel lubricating oil composition of the invention containing the prescribed polyalkoxylated alkyl polyoxyalkyl amine friction modifier was evaluated in a commercial crankcase diesel lubricating oil composition. The commercial lubricant, or base oil, and the modified oil containing the friction modifier of the invention, were tested for their friction properties in the Small Engine Friction Test described above.

The following examples provided below in Table III, illustrate the effectiveness of the additive of the invention in a 3–5 TBN range crankcase oil composition.

TABLE III

| FOUR-BALL COEFFICIENT OF FRICTION TEST | | | | | |
|---|---|---|---|---|---|
| | | Modified Crankcase Oil | | | |
| Composition, Volume % | Base Blend | Oil A | Oil B | Oil C | Oil D |
| Solvent Neutral Oil 20 (SNO-20)[a] | 6.72 | 6.72 | 6.72 | 6.72 | 6.72 |
| Solvent Neutral Oil 40 (SNO-40)[b] | 57.70 | 56.70 | 56.70 | 56.70 | 56.70 |
| Bright Stock 145[c] | 24.30 | 24.30 | 24.30 | 24.30 | 24.30 |
| Zinc dithiophosphate | 1.02 | 1.02 | 1.02 | 1.02 | 1.02 |
| Mono (B-hydroxyethyl) alkene thiophosphonate | 7.76 | 7.76 | 7.76 | 7.76 | 7.76 |

TABLE III-continued

FOUR-BALL COEFFICIENT OF FRICTION TEST

| Composition, Volume % | Base Blend | Modified Crankcase Oil Oil A | Oil B | Oil C | Oil D |
|---|---|---|---|---|---|
| Overbased calcium sulfonate | 1.40 | 1.40 | 1.40 | 1.40 | 1.40 |
| Commercial viscosity index improver | 0.75 | 0.75 | 0.75 | 0.75 | 0.75 |
| Oxidation Inhibitor | 0.35 | 0.35 | 0.35 | 0.35 | 0.35 |
| Anitfoamant, ppm | 170 | 170 | 170 | 170 | 170 |
| Surfactant M-30 | — | 1.0 | | | |
| Surfactant M-320 | — | | 1.0 | | |
| Surfactant M-310 | — | | | 1.0 | |
| Commercial Friction Modifier | — | | | | 1.0 |
| Coefficient of Friction | 0.085 | 0.071 | 0.080 | 0.081 | 0.084 |
| % Improvement over Base Blend | — | 16.0 | 4.9 | 4.7 | 1.2 |

[a]SNO-20: a paraffinic mineral oil having a 100° C. viscosity of 8.46 cSt
[b]SNO-40: a paraffinic mineral oil having a 100° C. viscosity of 14.50 cSt
[c]Bright Stock 145: a paraffinic mineral oil having a 100° C. viscosity of 28.4 cSt The foregoing examples demonstrate an unexpected effectiveness of TCC Surfactant M-305 as a friction modifier for reducing engine motor torque in the prescribed gasoline crankcase oil composition of the invention to provide attendant fuel economies.

We claim:

1. A gasoline crankcase engine lubricant composition comprising
   (a) a major portion of a gasoline crankcase lubricating oil and
   (b) a minor amount of, as a friction modifying agent, a dialkoxylated alkyl polyoxyalkyl amine.

2. The lubricant composition of claim 1, wherein said polyoxyalkyl amine is represented by the formula

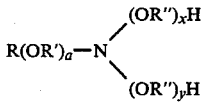

wherein R is a ($C_1$–$C_{20}$) alkyl hydrocarbon group, R′ and R″ are ($C_1$–$C_{10}$) divalent alkylene hydrocarbon groups, x+y is a value of about 1 to about 20 and a is an integer of about 1 to about 10.

3. The lubricant composition of claim 2, wherein R is a straight chain alkyl group.

4. The lubricant composition of claim 2, wherein R contains from about 10 to about 15 atoms.

5. The lubricant composition of claim 2, wherein R contains from about 10 to about 12 carbon atoms.

6. The lubricant composition of claim 2, wherein R′ contains from about 2 to about 3 carbon atoms.

7. The lubricant composition of claim 2, wherein R′ is

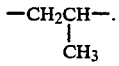

8. The lubricant composition of claim 2, wherein R″ contains from about 2 to about 3 carbon atoms.

9. The lubricant composition of claim 2, wherein R″ is [—$CH_2$—$CH_2$—].

10. The lubricant composition of claim 2, wherein a is an integer of about 1 to about 5.

11. The lubricant composition of claim 2, wherein a is an integer of about 1 to about 2.

12. The lubricant composition of claim 2, wherein x+y is a value of about 15.

13. A gasoline crankcase lubricanting oil composition comprising:
   (a) a major portion of a gasoline crankcase lubricanting oil;
   (b) an 18:1 overbased calcium sulfonate in an amount to impart a TBN of about 0 to about 10 to said lubricating oil composition;
   (c) from about 0.1 to about 2.0 wt.% of a zinc dithiophosphate; and
   (d) a minor friction modifying amount of about 0.5 wt.% to about 2.0 wt.% of a dialkoxyalated alkyl polyoxylakly amine

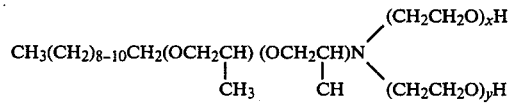

where x+y is a value of about 20.

14. The lubricating oil composition of claim 13, wherein the zinc dithiophosphate is represented by the formula

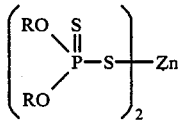

where R is a ($C_1$–$C_{20}$) hydrocarbyl radical.

15. The lubricating oil composition of claim 13, wherein said lubricating oil composition contains an, as an oxidation inhibitor, alkylated diphenylamine

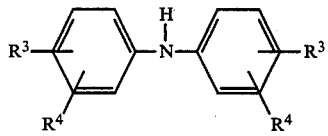

where $R^3$ is a ($C_1$–$C_4$) alkyl radical and $R^4$ is a ($C_4$–$C_{16}$) alkyl radical.

* * * * *